US012773082B1

(12) United States Patent
Feng

(10) Patent No.: US 12,773,082 B1
(45) Date of Patent: Oct. 27, 2026

(54) CLEANING DEVICE WITH DUST COLLECTION STRUCTURE

(71) Applicant: Shenzhen Longquanshan Art Technology Co., Ltd., Shenzhen (CN)

(72) Inventor: Ye Feng, Shenzhen (CN)

(73) Assignee: Shenzhen Longquanshan Art Technology Co., Ltd., Shenzhen (CN)

( * ) Notice: Subject to any disclaimer, the term of this patent is extended or adjusted under 35 U.S.C. 154(b) by 0 days.

(21) Appl. No.: 19/220,238

(22) Filed: May 28, 2025

(30) Foreign Application Priority Data

Apr. 25, 2025 (CN) ..... 202520813547.7

(51) Int. Cl.

| | |
|---|---|
| ***A47L 11/33*** | (2006.01) |
| ***A46B 7/06*** | (2006.01) |
| ***A46B 9/02*** | (2006.01) |
| ***A46B 13/08*** | (2006.01) |
| ***A47L 11/22*** | (2006.01) |
| ***A47L 11/32*** | (2006.01) |
| ***A47L 11/40*** | (2006.01) |

(52) U.S. Cl.
CPC ..... *A47L 11/33* (2013.01); *A46B 7/06* (2013.01); *A46B 9/026* (2013.01); *A46B 13/08* (2013.01); *A47L 11/22* (2013.01); *A47L 11/32* (2013.01); *A47L 11/4025* (2013.01); *A47L 11/4075* (2013.01)

(58) Field of Classification Search
CPC ..... A47L 11/00; A47L 11/22; A47L 11/26; A47L 11/32; A47L 11/33; A47L 11/40; A47L 11/4036; A47L 11/4027; A47L 11/4013; A47L 11/4041; A47L 11/4075; A47L 13/08; A46B 13/00; A46B 13/001; A46B 13/08; A46B 7/06
See application file for complete search history.

(56) References Cited

U.S. PATENT DOCUMENTS

2009/0223006 A1* 9/2009 Sato ..... A46B 13/001 15/52.1
2010/0229315 A1* 9/2010 Rosenzweig ..... B25G 3/38 15/144.1

FOREIGN PATENT DOCUMENTS

CN 211534281 U * 9/2020
JP H11178766 A * 7/1999
WO WO-2022247659 A1 * 12/2022 ..... A47L 11/20

* cited by examiner

*Primary Examiner* — C. A. Rivera
(74) *Attorney, Agent, or Firm* — AVEK IP, LLC

(57) ABSTRACT

A cleaning device includes a base, a dust collection structure, a dust removal structure, and a handle. The base defines a receiving cavity and a first opening. The dust collection structure includes a dust collection body. The dust collection body defines a dust collection chamber with a dust collection port. The dust collection body includes a dust collection face. When the dust collection body rotates, the dust removal structure scrapes the dust collection face and carries dust on the dust collection face to the dust collection chamber through the dust collection port. A central axis of the handle forms an angle with a tangent line at a lowest point of the dust collection face. The angle is in a range of 25 degrees to 35 degrees. A ratio of a maximum length of the handle to a width of the dust collection body is greater than or equal to 4.

15 Claims, 16 Drawing Sheets

CLEANING DEVICE WITH DUST COLLECTION STRUCTURE

CROSS REFERENCE TO RELATED APPLICATIONS

The present application claims the priority of the Chinese patent application No. 202520813547.7, filed on Apr. 25, 2025, contents of which are incorporated herein by its entireties.

FIELD

The present disclosure relates to the field of cleaning, and particularly to a cleaning device.

BACKGROUND

Cleaning tools in related art are mostly used for cleaning small and soft items such as sofas, cat beds, dog beds, or bedding. As a result, the cleaning tools in the related art are generally small in size, and an angle between a base and a handle is typically close to horizontal, allowing users to push the cleaning tools horizontally during use. However, this design is not suitable for cleaning carpets. Carpets are laid on the ground and cover a large area, requiring cleaning devices to have a larger size and a more suitable operational angle.

Therefore, it is necessary to improve the cleaning tools in the related art to avoid the aforementioned drawbacks.

SUMMARY

A cleaning device is provided in the present disclosure. The cleaning device includes a base, a dust collection structure, a dust removal structure, and a handle. The base defines a receiving cavity and a first opening facing downward. The first opening is in communication with the receiving cavity. The dust collection structure includes a dust collection body rotatably arranged in the receiving cavity. The dust collection body defines a dust collection chamber with a dust collection port. The dust collection port is in communication with the dust collection chamber. The dust collection body includes a dust collection face. At least a portion of the dust collection face is exposed through the first opening. The dust collection face is capable of rolling contact with an object to be cleaned. The dust removal structure is located at the first opening and arranged opposite to the dust collection face. When the dust collection body rotates, the dust removal structure scrapes the dust collection face and carries dust on the dust collection face to the dust collection chamber through the dust collection port. The handle is connected to the base. A central axis of the handle forms an angle with a tangent line at a lowest point of the dust collection face. The angle is in a range of 25 degrees to 35 degrees. A ratio of a maximum length of the handle to a width of the dust collection body is greater than or equal to 4.

REFERENCE NUMERALS IN THE DRAWINGS

Figure 1:
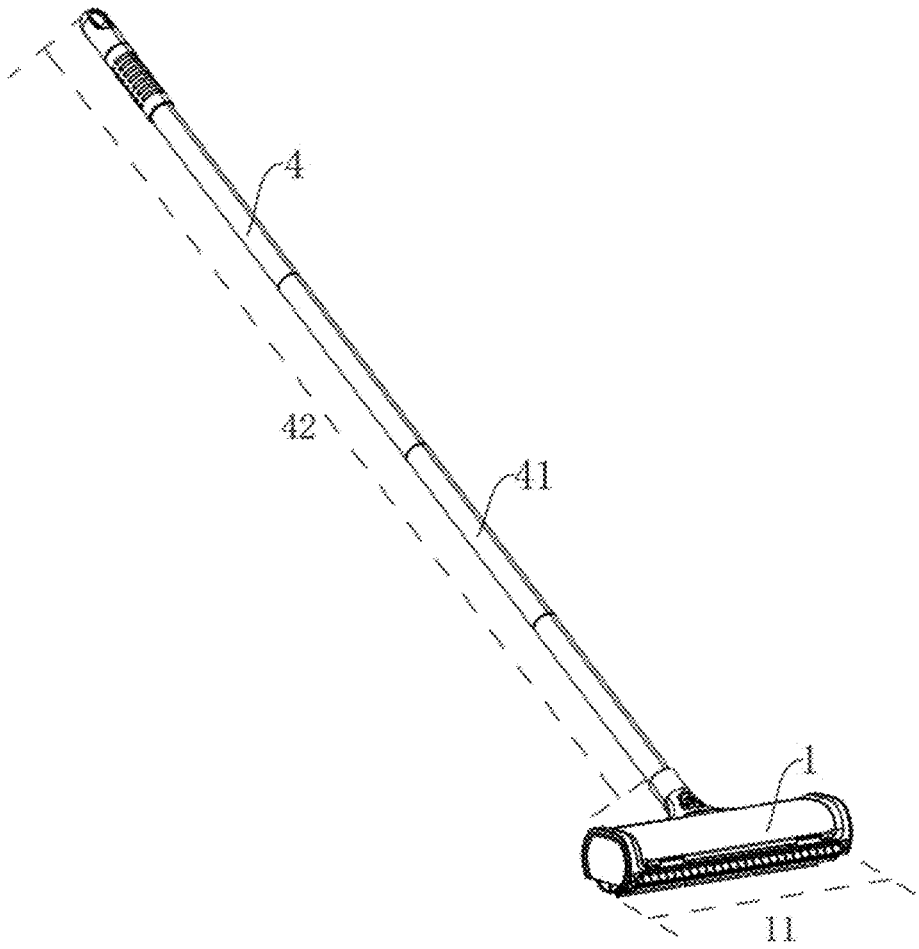
FIG. 1 is a structural view of a cleaning device according to an embodiment of the present disclosure.

1—base; 11—width of the base; 12—receiving cavity; 13—first opening; 14—second opening; 15—first housing; 151—first frame portion; 152—handle portion; 153—first extension portion; 1521—first ring wall; 1522—second ring wall; 1523—reinforcing rib; 16—second housing; 161—second frame portion; 162—second extension portion; 17—body portion; 18—slanted portion; 181—first end; 182—second end; 183—first side face; 184—second side face; 19—limiting face; 110—top wall; 111—boss; 1111—bottom face of the protrusion; 112—soundproof strip; 113—end wall; 114—auxiliary wheel; 115—end cover; 116—button mechanism; 1161—button; 11611—guide structure; 1162—mounting seat; 11621—vertical plate; 11622—sliding slot; 1163—latch; 11631—connecting structure; 11632—guide hole; 1164—elastic member; 117—cover; 1171—connecting end; 1172—free end; 11721—door latch; 118—anti-collision strip; 119—front side wall; 120—rotating shaft; 121—torsion spring; 122—protrusion; 2—dust collection structure; 21—dust collection body; 211—dust collection chamber; 212—dust collection port; 2121—front edge; 2122—rear edge; 213—outer peripheral face; 214—dust collection face; 2141—front dust removal region; 2142—rear dust removal region; 215—bristles; 22—protruding strip; 221—third end; 222—fourth end; 223—front side face; 224—rear side face; 225—engagement groove; 23—paddle; 3—dust removal structure; 31—front dust removal body; 311—front dust removal face; 32—rear dust removal body; 321— rear dust removal face; 4—handle; 41—connecting segment; 42—maximum length of the handle.

DETAILED DESCRIPTION

To make the above objectives, features, and advantages of the present disclosure more comprehensible, the following provides a detailed description of specific embodiments of the present disclosure with reference to the accompanying drawings.

It should be noted that the terms "first," "second," and the like in the specification and claims of the present disclosure are used to distinguish similar objects and do not necessarily describe a specific order or sequence. It should be understood that such terms may be interchangeable under appropriate circumstances, so that the embodiments of the present disclosure described herein can be implemented in orders other than those illustrated or described.

In the description of the present disclosure, it should be noted that unless otherwise explicitly specified or defined, the terms "disposed," "mounted," "connected," and "linked" should be interpreted broadly. For example, they may refer to fixed connections, detachable connections, or integrated connections; mechanical connections; direct connections, or indirect connections through an intermediate medium. For those skilled in the art, the specific meanings of the above terms in the present disclosure can be understood based on the specific context.

In the description of the specification, references to terms such as "embodiment," "one embodiment," and "one implementation" mean that specific features, structures, materials, or characteristics described in the embodiment or implementation are included in at least one embodiment or implementation of the present disclosure. In the specification, the schematic descriptions of the above terms do not necessarily refer to the same embodiment or implementation. Moreover, the described specific features, structures, materials, or characteristics may be combined in any one or more embodiments or implementations in a suitable manner.

The following provides a detailed description of the present disclosure with reference to the accompanying drawings.

To address the aforementioned technical issues, as shown in FIGS. 1, 2, 3, 4, 5A, 5B, 13, and 14, an embodiment of the present disclosure provides a cleaning device. The cleaning device includes a base 1, a dust collection structure 2, a dust removal structure 3, and a handle 4. The base 1 defines a receiving cavity 12 and a first opening 13 facing downward. The first opening 13 is in communication with the receiving cavity 12. The first opening 13 is defined along a width direction of the base 1. The dust collection structure 2 includes a dust collection body 21. Particularly, the dust collection body 21 is configured as a hollow semi-cylindrical structure. Each of two ends of the dust collection body 21 is rotatably arranged on a respective one of two end walls 113 of the base 1, thereby allowing the dust collection body 21 to be rotatably arranged in the receiving cavity 12. The dust collection body 21 defines a dust collection chamber 211. A top portion of the dust collection body 21 defines a dust collection port 212. The dust collection port 212 is in communication with the dust collection chamber 211. The dust collection body 21 can rotate about a central axis of the dust collection body 21. A dust collection face 214 is an outer peripheral face 213 of the dust collection body 21. The dust collection face 214 is configured as a curved face centered on the central axis of the dust collection body 21. At least a portion of the dust collection face 214 is exposed through the first opening 13 to come into contact with an object to be cleaned. The dust collection face 214 rolls back and forth to capture dust, hair, and other debris on a carpet. The base 1 is further arranged with the dust removal structure 3. The dust removal structure 3 is located at the first opening 13 and arranged adjacent to the dust collection face 214 of the dust collection body 21. When the dust collection face 214 rolls back and forth, the dust removal structure 3 scrapes the dust collection face 214 to carry the debris on the dust collection face 214 to the dust collection chamber 211 through the dust collection port 212. A central axis of the handle 4 forms an angle with a tangent line at a lowest point of the dust collection face 214. The angle is in a range of 25 degrees to 35 degrees. In this way, a force applied by the user when pushing or pulling the handle 4 is allowed to be more distributed in a horizontal direction, making it easier for the user to push or pull the cleaning device. Additionally, this angle ensures that the handle 4 has sufficient height for the user to operate while standing. Particularly, the angle is in a range of 28 degrees to 33 degrees. When the angle is reduced (e.g., close to 25 degrees), more force is distributed horizontally. When the angle is in a range of 28 degrees to 33 degrees, horizontal force distribution and an appropriate handle height can be balanced. In another example, the angle is 30 degrees, which suits a force application angle and height of most users. A ratio of a maximum length 42 of the handle 4 to a width 11 of the dust collection body 21 is greater than or equal to 4. The maximum length 42 of the handle 4 can be adjusted according to different user groups. For example, for users in Asia, the handle 4 is typically set between 1.2 meters and 1.3 meters; for users in Europe and America, where average heights are generally taller, the handle 4 is usually set between 1.4 meters and 1.5 meters. The present disclosure increases the width of the dust collection body 21 and the length 42 of the handle 4, allowing users to clean large-area carpets while standing and holding the handle 4. Compared to cleaning small areas such as sofas or beds, in large-area carpet cleaning scenarios, when the handle is not long enough, users must frequently bend or squat to move the cleaning device, which not only causes back pain but also significantly reduces cleaning efficiency. When the width of the dust collection body 21 is insufficient, a cleaning area covered during each rolling motion is limited, requiring users to move the cleaning device frequently, making it difficult to clean large carpets efficiently.

Figure 2:
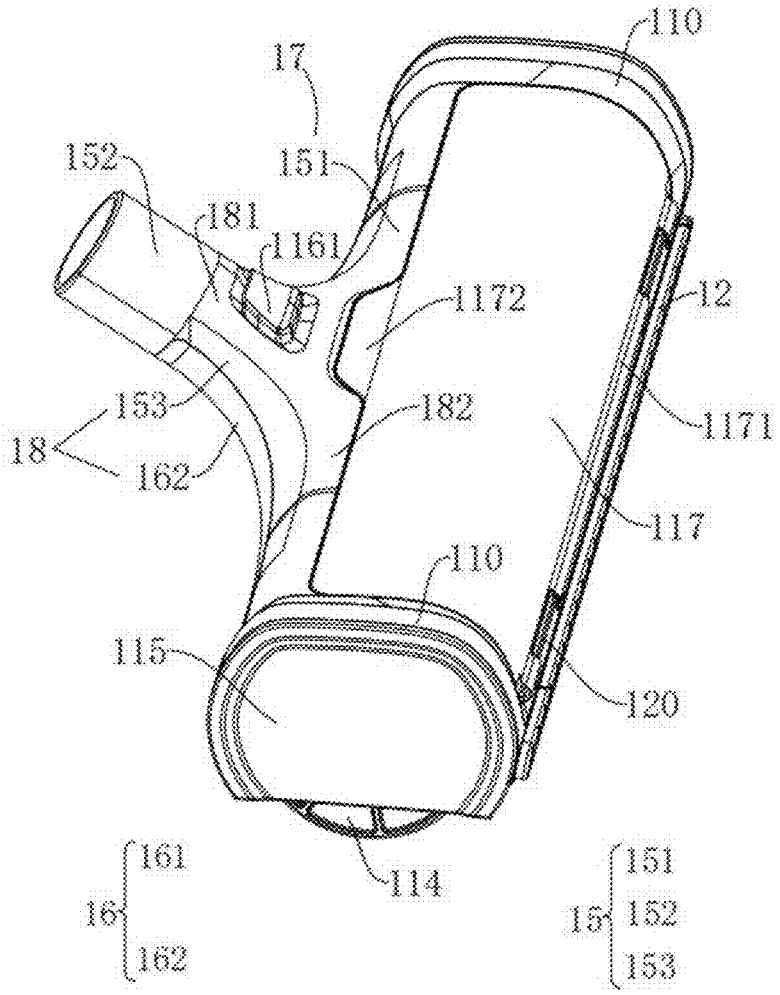
FIG. 2 is a structural view of a partial structure of the cleaning device according to an embodiment of the present disclosure.
Figure 3:
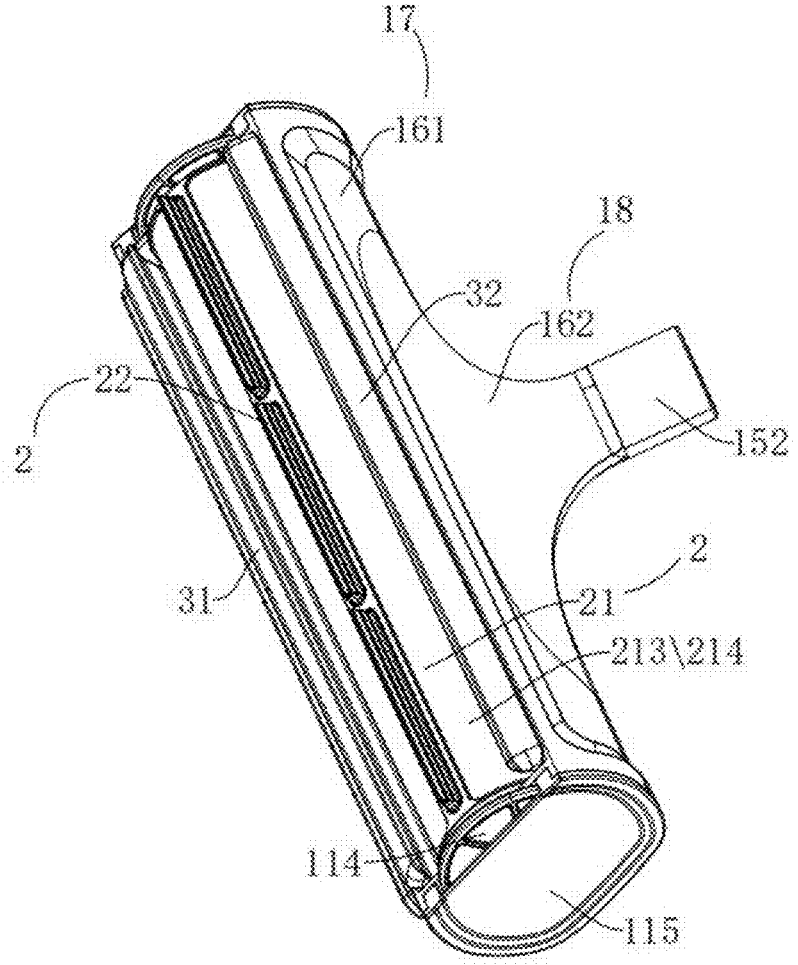
FIG. 3 is a schematic view of a partial structure of the cleaning device from another perspective view according to an embodiment of the present disclosure.
Figure 4:
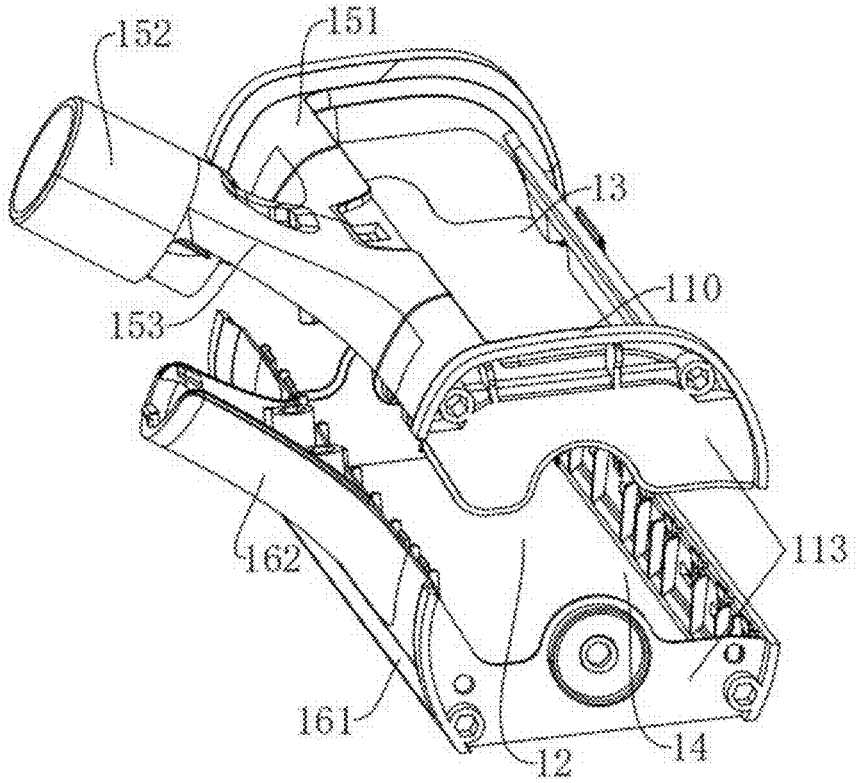
FIG. 4 is an exploded view of a first housing and a second housing according to an embodiment of the present disclosure.

In one embodiment of the present disclosure, as shown in FIGS. 2, 3, and 4, the base 1 includes a first housing 15 and a second housing 16. The first housing 15 and the second housing 16 are arranged in an up-down relationship. An edge of one of the first housing 15 and the second housing 16 is arranged with a plurality of clasps, while an edge of the other of the first housing 15 and the second housing 16 defines a plurality of slots, allowing the first housing 15 and the second housing 16 to be snap-fitted with each other. The first housing 15 includes a first frame portion 151 and a handle portion 152. Optionally, the handle portion 152 is configured as a closed ring structure. The handle 4 is directly connected to and arranged in the ring structure. The handle portion 152 is integrally formed as a one-piece structure to enhance connection strength between the handle portion 152 and the handle 4. The second housing 16 includes a second frame portion 161. The first frame portion 151 and the second frame portion 161 cooperatively form a body portion 17 of the base 1. The receiving cavity 12 is defined in the body portion 17. The base 1 includes the first housing 15 and the second housing 16, not only reducing difficulty of mold design for the base 1 but also making the base 1 easier to disassemble for maintenance.

Figure 10:
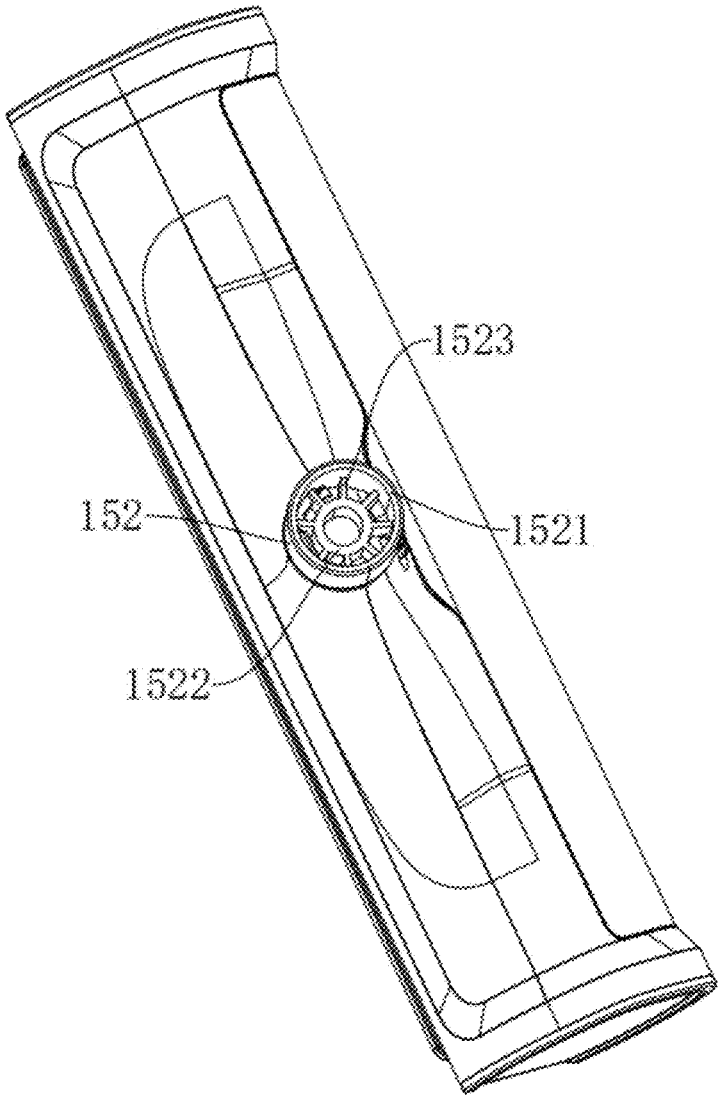
FIG. 10 is a structural view of a handle portion according to an embodiment of the present disclosure.

In one embodiment of the present disclosure, as shown in FIG. 10, the handle portion 152 includes a first ring wall 1521, a second ring wall 1522, and a plurality of reinforcing ribs 1523. Optionally, each of the first ring wall 1521 and the second ring wall 1522 is configured as a cylindrical structure. The first ring wall 1521 sleeves a periphery of the second ring wall 1522, and the first ring wall 1521 is spaced apart from the second ring wall 1522. The plurality of reinforcing ribs 1523 are connected to and arranged between the first ring wall 1521 and the second ring wall 1522. Particularly, the plurality of reinforcing ribs 1523 are arranged radially around the first ring wall 1521. An end of the handle 4 is arranged with a connecting member. The connecting member may be a soft rubber plug. The soft rubber plug can be directly inserted in the second ring wall 1522. The connecting member may also be a threaded connector with external threads, the first ring wall 1521 is arranged with internal threads engaged with the external threads, and the connecting member is in a threaded connection with the first ring wall 1521. The plurality of reinforcing ribs 1523 can enhance the connection strength between the handle portion 152 and the handle 4, making the cleaning device more durable.

Figure 5A:
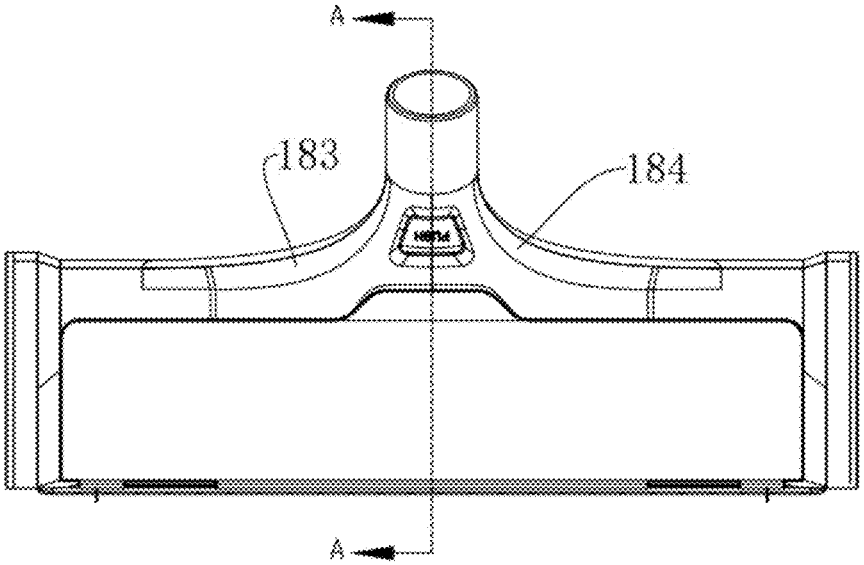
FIG. 5A is a top view of a partial structure of the cleaning device according to an embodiment of the present disclosure.

In one embodiment of the present disclosure, as shown in FIGS. 2, 4, and 5A, the first housing 15 further includes a first extension portion 153, and the first extension portion 153 extends obliquely backward from a middle portion of the first frame portion 151. The second housing 16 further includes a second extension portion 162, and the second extension portion 162 extends obliquely backward from a middle portion of the second frame portion 161. The first extension portion 153 and the second extension portion 162 cooperatively form a slanted portion 18 of the base 1. The slanted portion 18 includes a first end 181 and a second end 182. The first end 181 is connected to the handle portion 152. The handle 4, the handle portion 152, and the slanted portion 18 are coaxially arranged. In other words, an inclination angle of the slanted portion 18 is the same as an inclination angle of the handle 4 described above. The second end 182 is connected to the body portion 17. A width of the slanted portion 18 gradually increases from the first end 181 to the second end 182. In the present disclosure, the first extension portion 153 and the second extension portion 162 are roughly equally divided to form the body portion 17. A cross section of the slanted portion 18 from the first end 181 to the second end 182 is a cross section made along a seam of the first extension portion 153 and the second extension portion 162. A width of the cross section of the slanted portion 18 gradually increases from the first end 181 to the second end 182, giving the slanted portion 18 a larger width near the body portion 17. In this way, torsional and bending resistance of the slanted portion 18 can be enhanced, providing stronger support for the base 1.

In one embodiment of the present disclosure, as shown in FIGS. 2, 4, and 5A, the slanted portion 18 includes a first side face 183 and a second side face 184. Each of the first side face 183 and the second side face 184 intersects with the cross section of the slanted portion 18. The first extension portion 153 and the second extension portion 162 are combined with each other in an up-down relationship. Each of the first side face 183 and the second side face 184 is a respective one of two side faces along the seam of the first extension portion 153 and the second extension portion 162. Optionally, each of the first side face 183 and the second side face 184 is configured as an arc-shaped face. Since the gradual increase in the width of the cross section of the slanted portion 18 from the first end 181 to the second end 182, the first side face 183 and the second side face 184 are two arc-shaped faces with opposing curvatures. Since each of the first side face 183 and the second side face 184 is the arc-shaped face, the force on the slanted portion 18 can be better distributed, further enhancing impact resistance of the slanted portion 18. Alternatively, each of the first side face 183 and the second side face 184 may be roughly planar, arranged in a V-shape to connect the handle portion 152 and the body portion 17.

In one embodiment of the present disclosure, as shown in FIGS. 2, 3, and 4, the first frame portion 151, the first extension portion 153, and the handle portion 152 are integrally formed as a one-piece structure, ensuring seamless connections between the first frame portion 151, the first extension portion 153, and the handle portion 152 and reducing a risk of loosening or breakage. Similarly, the second frame portion 161 and the second extension portion 162 are also integrally formed as a one-piece structure, further optimizing structural integrity of the base 1. In other words, only two molds are needed for production of the base 1.

Figure 5B:
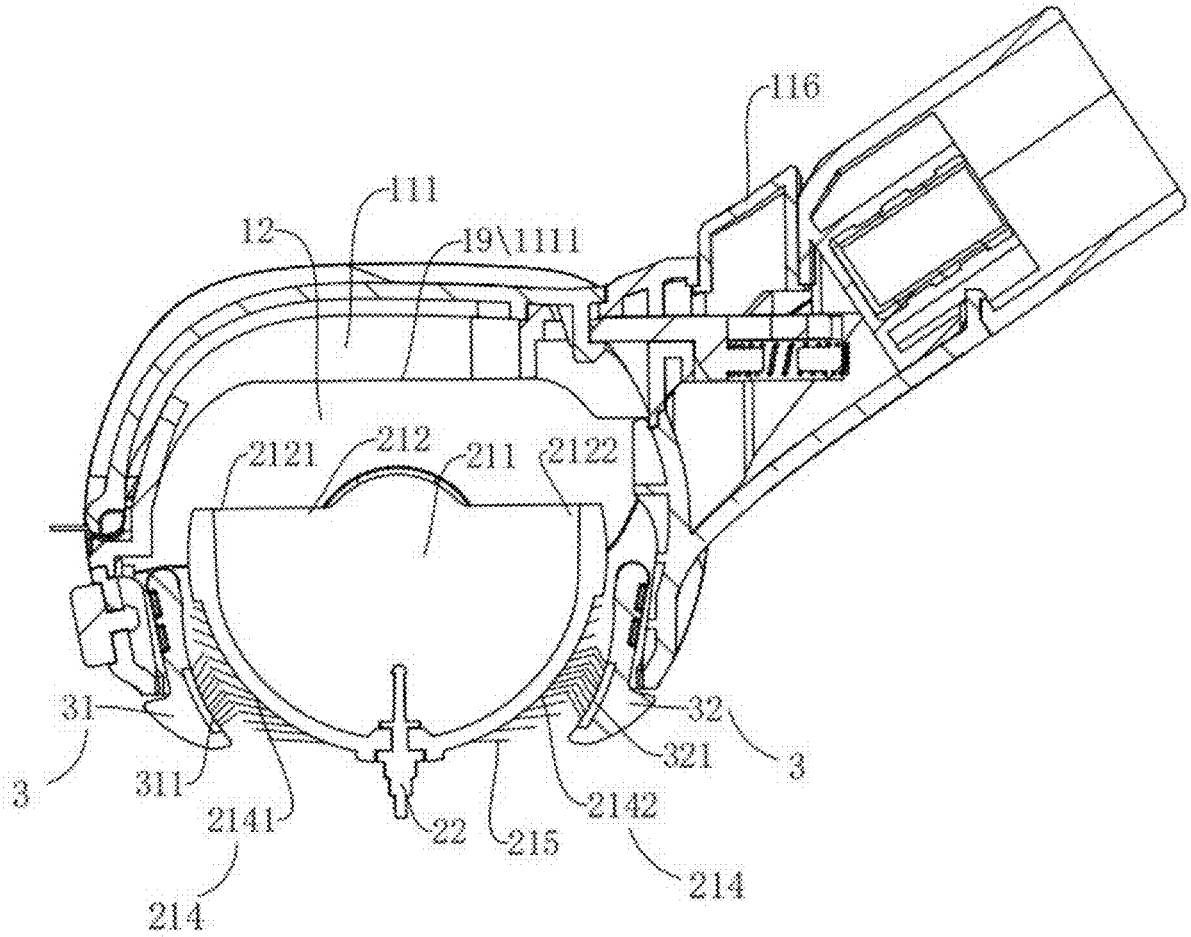
FIG. 5B is a cross-sectional view taken along line A-A in FIG. 5A.
Figure 6A:
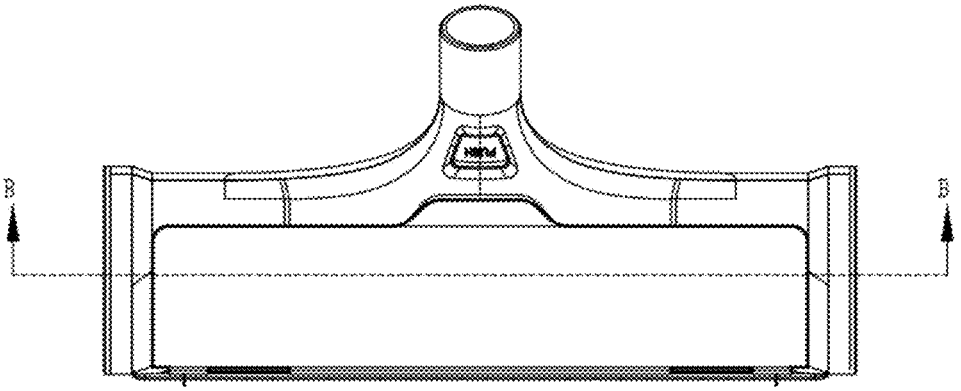
FIG. 6A is another top view of a partial structure of the cleaning device according to an embodiment of the present disclosure.
Figure 6B:
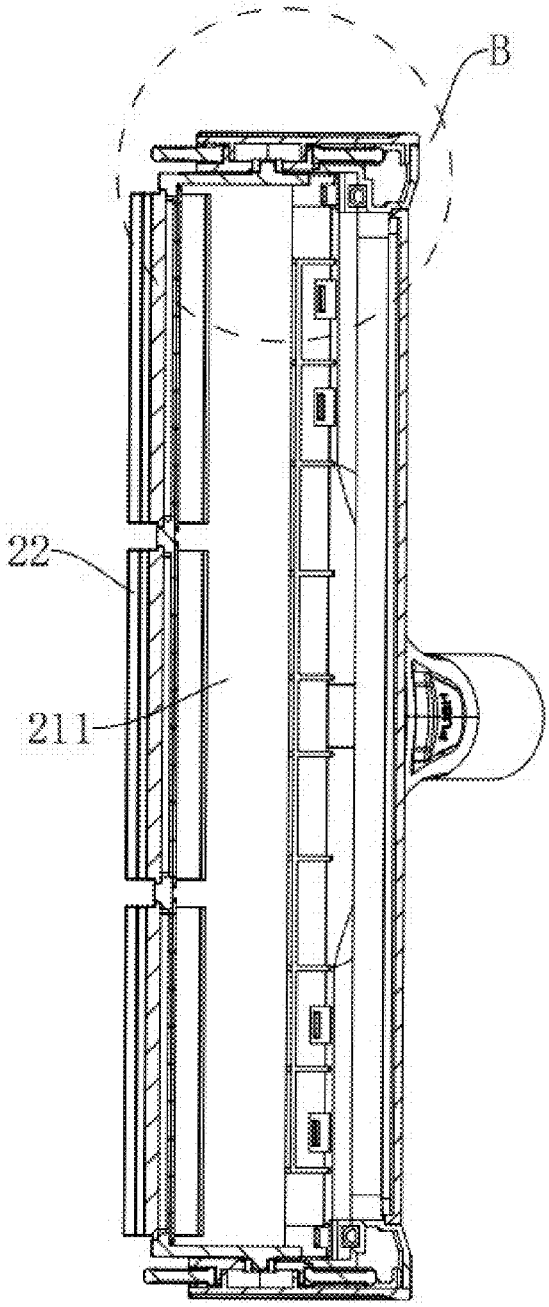
FIG. 6B is a cross-sectional view taken along line B-B in FIG. 6A.

In one embodiment of the present disclosure, as shown in FIGS. 5A, and 5B, the base 1 includes at least one limiting face 19. The dust collection body 21 rotates about the central axis of the dust collection body 21. The limiting face 19 can restrict the dust collection body 21, particularly, restrict a rotation angle of the dust collection body 21 to less than 360 degrees, meaning that the dust collection body 21 rolls back and forth around the central axis during cleaning. Optionally, the limiting face 19 is located above the dust collection body 21, and a perpendicular distance from the limiting face 19 to the central axis of the dust collection body 21 is less than a rotation radius of the dust collection body 21, thereby restricting the dust collection body 21, preventing the dust collection body 21 from over-rotating or wobbling during operation, particularly avoiding spillage of debris from the dust collection chamber 211 through the first opening 13. The limiting face 19 may be located on the base 1 or the cover 117, as long as the limiting face 19 restricts a rotation of the dust collection body 21.

In one embodiment of the present disclosure, as shown in FIGS. 3, 6A, 6B, and 7, the base 1 includes a top wall 110. The top wall 110 is arranged with at least one boss 111 extending toward the dust collection body 21, the at least one boss 111 is flat and arc-shaped. The boss 111 is located on a rotation path of the dust collection body 21. Optionally, the boss 111 is arranged along a circumferential direction of the dust collection body 21, and a curvature of the boss 111 is reduced at a highest point along the circumferential direction of the dust collection body 21. The limiting face 19 is a bottom face 1111 of the boss 111, which restricts the dust collection body 21. Optionally, the top wall 110 defines a second opening 14 for emptying debris from the dust collection chamber 211. The at least one boss 111 may be selectively defined at two ends of the top wall 110. Particularly, the number of the at least one boss 111 is two. Each of the two bosses 111 is arranged on a respective one of two ends of the top wall 110. The two bosses 111 can simultaneously restrict the two ends of the dust collection body 21 for stability. The bosses 111 also help define the receiving cavity 12, eliminating a need for additional limiting structures.

Figure 7:
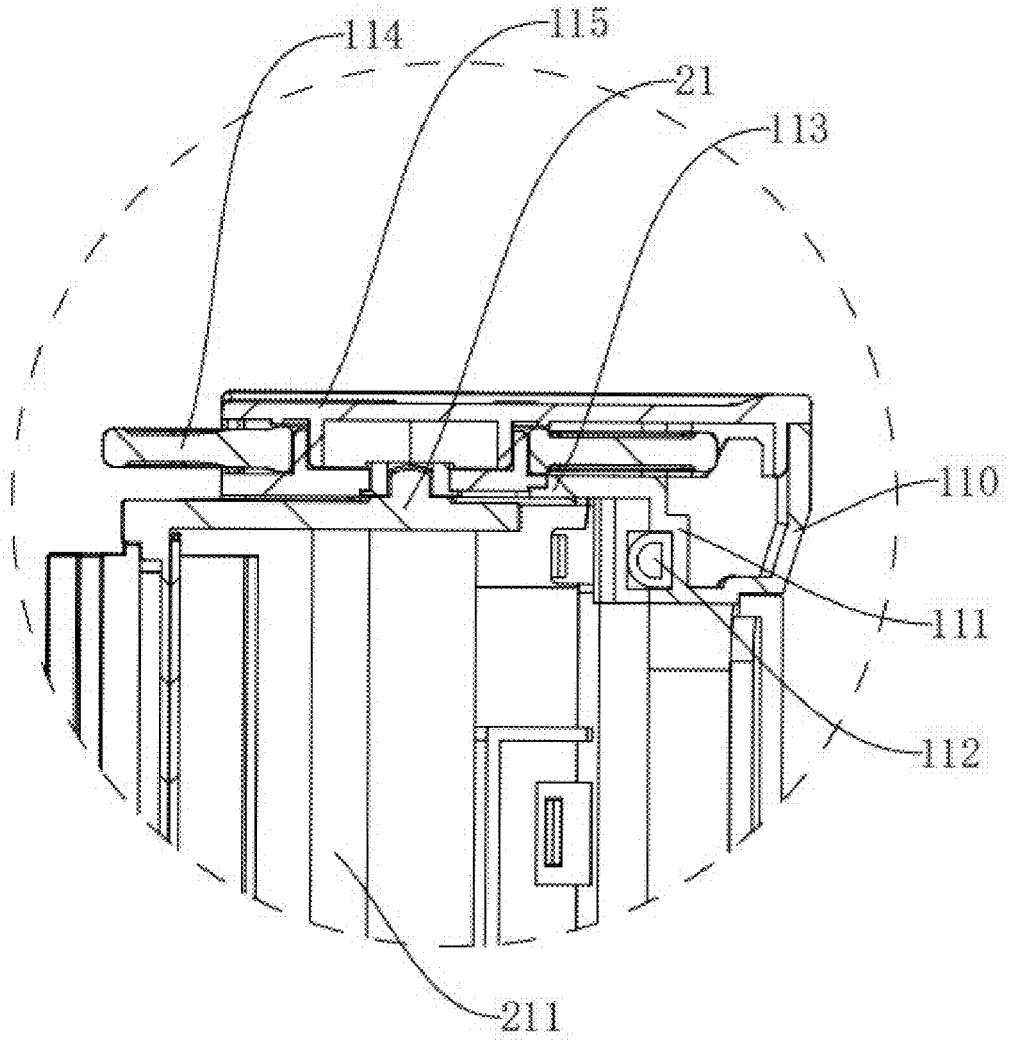
FIG. 7 is an enlarged view of a portion B in FIG. 6B.

In one embodiment of the present disclosure, as shown in FIG. 7, a soundproof strip 112 is arranged on the limiting face 19, and is arranged along a circumferential direction of the limiting face 19. Optionally, the limiting face 19 defines an accommodating recess. The soundproof strip 112 is accommodated in the accommodating recess and is partially exposed. When the dust collection body 21 rotates to a limit angle, the dust collection body 21 abuts against the soundproof strip 112. The soundproof strip 112 may be a hollow rubber seal or a flexible silicone strip.

In one embodiment of the present disclosure, as shown in FIG. 2, the base 1 further includes a cover 117. The base 1 defines a second opening 14 facing upward. The second opening 14 is in communication with the receiving cavity 12, allowing the debris in the dust collection body 21 to be emptied from the second opening 14. The cover 117 is movably arranged at the second opening 14 to close or open the second opening 14. Particularly, each of the top wall 110 of the base 1 and the cover 117 is also flat and arc-shaped, giving the cleaning device a sleek and modern appearance while reducing a height of the base 1 for access to low spaces like under beds or sofas. Additionally, the flat and arc-shaped top wall 110 can directly restrict the dust collection body 21.

Figure 12:
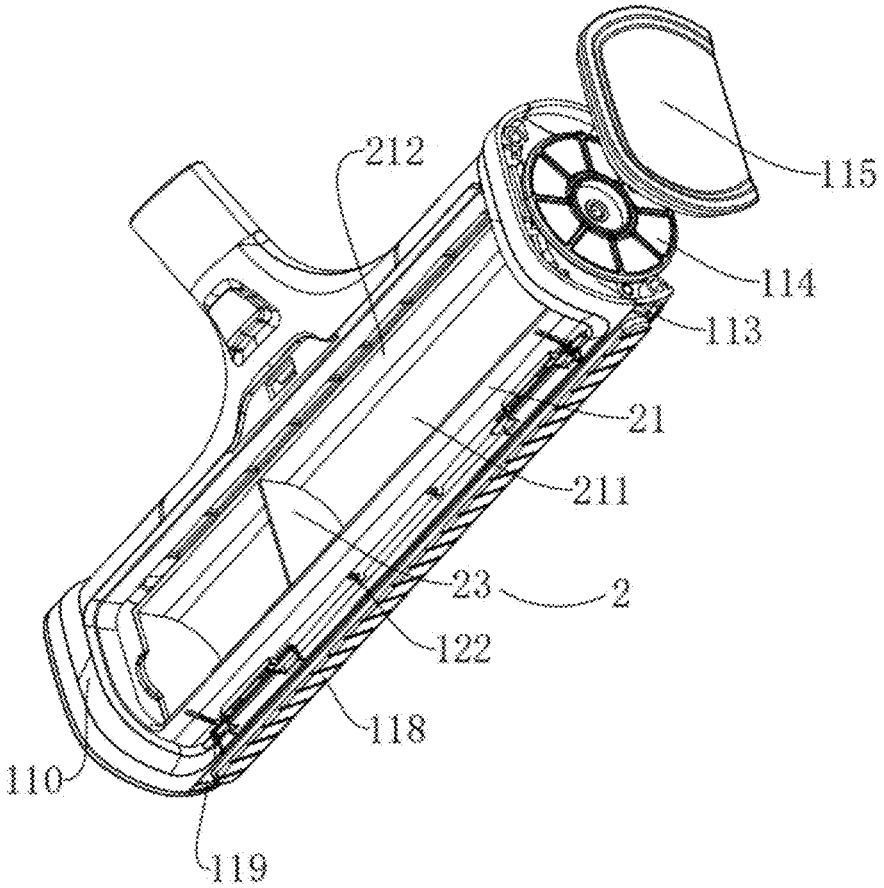
FIG. 12 is an exploded view of a partial structure of the cleaning device according to an embodiment of the present disclosure.
Figure 13:
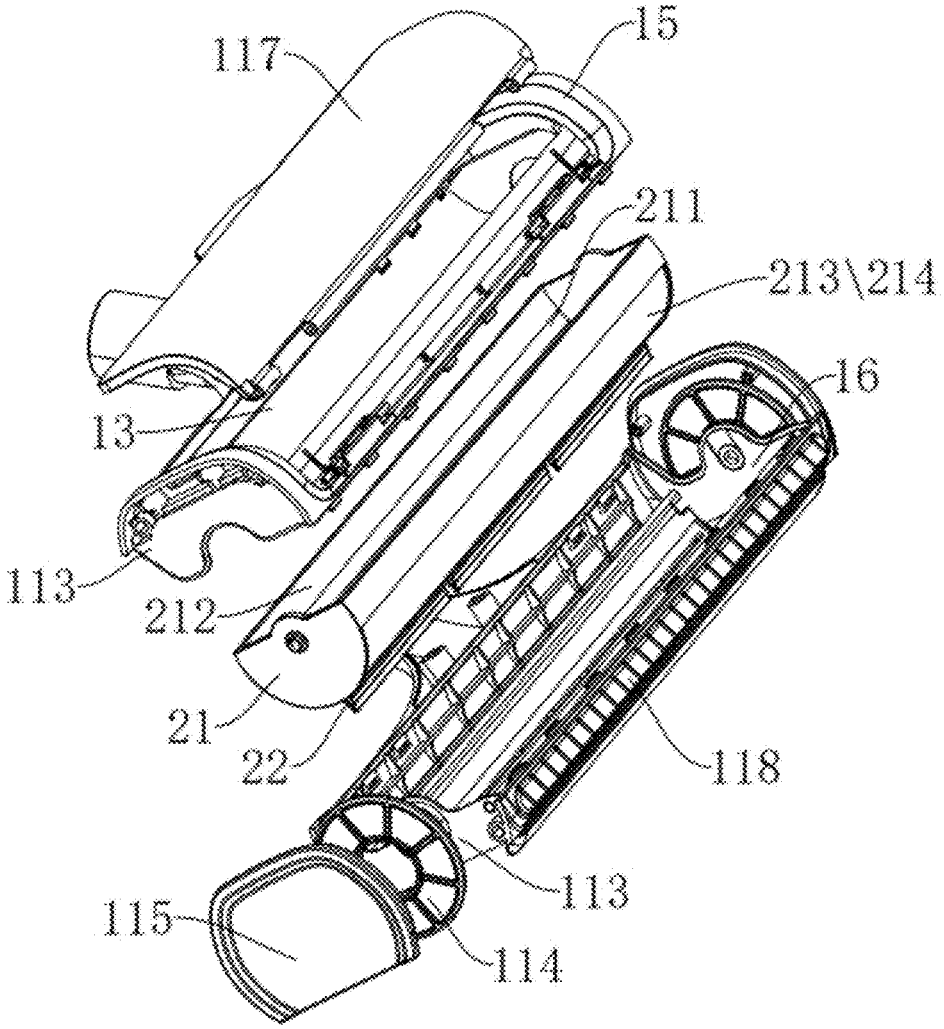
FIG. 13 is an exploded view of a partial structure of the cleaning device shown in FIGS. 2-3.
Figure 14:
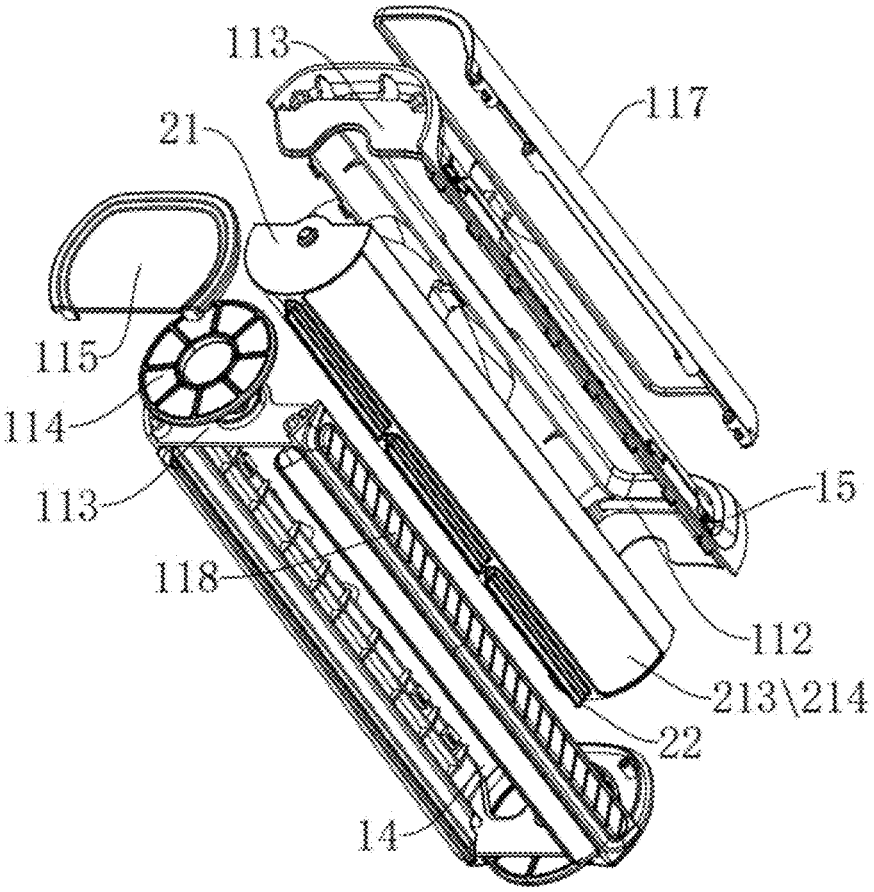
FIG. 14 is an exploded view of a partial structure of the cleaning device shown in FIGS. 2-3 from another perspective view.

In one embodiment of the present disclosure, as shown in FIG. 12, the dust collection structure 2 further includes two auxiliary wheels 114. The base 1 includes two end walls 113 and two end covers 115. Each of the two end covers 115 covers a respective one of the two end walls 113. The each of the two end covers 115 and the respective one of the two end walls 113 cooperatively define a respective receiving cavity. Each of the two auxiliary wheels 114 is rotatably arranged on a respective one of the two end walls 113 and located in a respective receiving cavity. A distance of a lowest point of the auxiliary wheels 114 protruding beyond the first opening 13 is 2-3 mm more than a distance of a lowest point of the dust collection face 214 protruding beyond the first opening 13. During cleaning, since carpets are flexible but not overly soft, the auxiliary wheels 114 contact the carpet first and sink, allowing the dust collection face 214 to subsequently contact the carpet. The 2-3 mm range ensures the dust collection face 214 is not too high, maintaining contact with the carpet.

Figure 11:
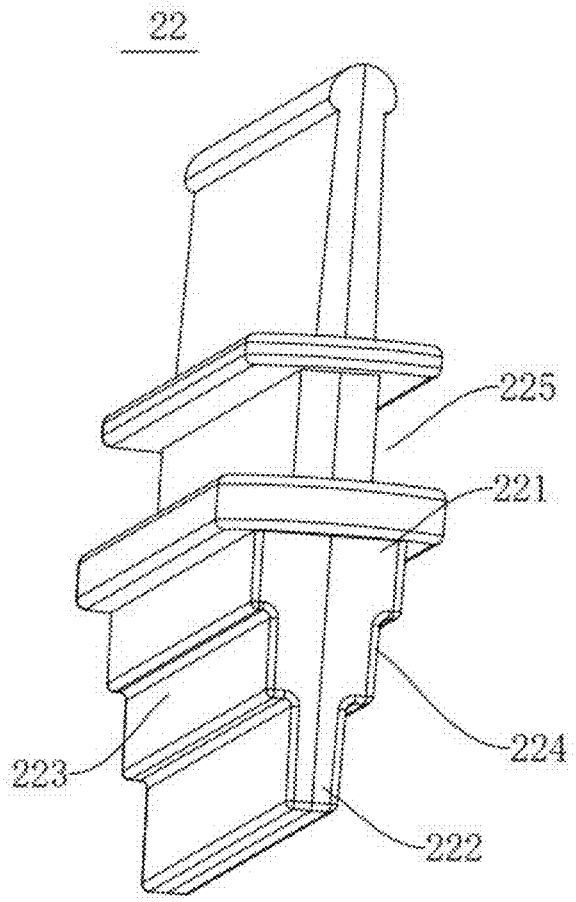
FIG. 11 is a structural view of a protrusion according to an embodiment of the present disclosure.

In one embodiment of the present disclosure, as shown in FIGS. 3 and 11, the dust collection structure 2 further includes at least one protruding strip 22. The protruding strip 22 is flexible and includes a third end 221 and a fourth end 222. The third end 221 is arranged on the dust collection face 214, and the fourth end 222 extends away from the dust collection face 214. A thickness of the protruding strip 22 decreases stepwise from the third end 221 to the fourth end 222. The protruding strip 22 has a front side face 223 and a rear side face 224. Each of the front side face 223 and the rear side face 224 is configured as a stepped face. The front side face 223 and the rear side face 224 are gradually close to each other from the third end 221 to the fourth end 222, reducing the thickness of the protruding strip 22. This stepped thickness provides sufficient rigidity for the protruding strip 22 to generate friction with the carpet, aiding the rotation of the dust collection body 21. Particularly, each of the front side face 223 and the rear side face 224 has at least two continuous steps, ensuring that parts of the front side face 223 and the rear side face 224 do not contact the carpet when the protruding strip 22 bends, preventing excessive friction between the protruding strip 22 and the carpet that would make the cleaning device difficult to push. Optionally, the third end 221 of the protruding strip 22 defines an engagement groove 225. The dust collection face 214 is engaged in the engagement groove 225 for assembly of the protruding strip 22. A plurality of protruding strips 22 are provided in some embodiments. The plurality of protruding strips 22 are arranged on the dust collection face 214 along the width direction of the base 1.

In one embodiment of the present disclosure, as shown in FIG. 5B, the dust collection face 214 includes a front dust removal region 2141, a rear dust removal region 2142, bristles 215 arranged on the front dust removal region 2141, and bristles 215 arranged on the rear dust removal region. The bristles 215 on the front dust removal region 2141 are inclined upward, generating friction with the carpet when the dust collection body 21 rolls backward to capture debris on the carpet. The dust removal structure 3 includes a front dust removal body 31. The front dust removal body 31 includes a front dust removal face 311 and bristles 215 arranged on the front dust removal face 311. The front dust removal face 311 is curved to be closely attached the front dust removal region 2141. The bristles 215 on the front dust removal face 311 are inclined upward toward the front dust removal region 2141. In this way, the debris from the bristles 215 on the front dust removal region 2141 can be carried to the dust collection chamber 211. Similarly, the bristles 215 on the rear dust removal region 2142 are inclined upward, generating friction with the carpet when the dust collection body 21 rolls forward to capture debris on the carpet. The dust removal structure 3 further includes a rear dust removal body 33. The rear dust removal body 32 includes a rear dust removal face 321 and bristles 215 arranged on the rear dust removal face 321. The rear dust removal face 321 is curved to be closely attached to the rear dust removal region 2142. The bristles 215 on the rear dust removal face 321 are inclined upward toward the rear dust removal region 2142. In this way, the debris from the bristles 215 on the rear dust removal region 2142 can be carried to the dust collection chamber 211.

In one embodiment of the present disclosure, as shown in FIG. 5B, the dust collection structure 2 further includes at least one protruding strip 22. The at least one protruding strip 22 is flexible and disposed at a middle portion of the dust collection face 214. The dust collection face 214 is divided to a front dust removal region 2141 and a rear dust removal region 2142. When the dust collection body 21 rotates to a limit position, the protruding strip 22 contacts the front dust removal body 31 or the rear dust removal body 32, further restricting a rotation of the dust collection body 21.

The operation of the cleaning device is explained comprehensively below. When the user pushes the cleaning device forward, the protruding strip 22 bends backward and generates friction with the carpet, driving the dust collection body 21 to rotate backward. At this time, the bristles 215 on the rear dust removal region 2142 capture dust and pet hair or other debris from the carpet. When the dust collection body 21 rotates backward to a limit position, the boss 111 limits the movement of the dust collection body 21, and the protruding strip 22 abuts against the rear dust removal body 32 and also simultaneously performs the limiting function. When the user pulls the cleaning device backward, the protruding strip 22 bends forward and generates friction with the carpet, driving the dust collection body 21 to rotate forward. At this point, the bristles 215 on the rear dust removal face 321 scrape the rear dust removal region 2142 and capture debris to the bristles 215 on the rear dust removal face 321, while simultaneously the bristles 215 on the front dust removal region 2141 capture debris on the carpet. When the dust collection body 21 rotates forward to a limit position, the boss 111 limits the dust collection body 21, and the protruding strip 22 abuts against the front dust removal body 31 and also performs the limiting function.

Repeating the rolling process once again, a rear edge 2122 of the dust collection port 212 scrapes the rear dust removal face 321 to collect debris to the dust collection chamber 211, and the bristles 215 on the front dust removal face 311 scrape the front dust removal region 2141 to capture debris on the bristles 215 of the front dust removal face 311. Likewise, during another repetition of the back-and-forth rolling process, a front edge 2121 of the dust collection port 212 scrapes the front dust removal face 311 and collects debris to the dust collection chamber 211. By repeating the above process, the cleaning device can continuously clean the debris on the carpet.

Figure 8:
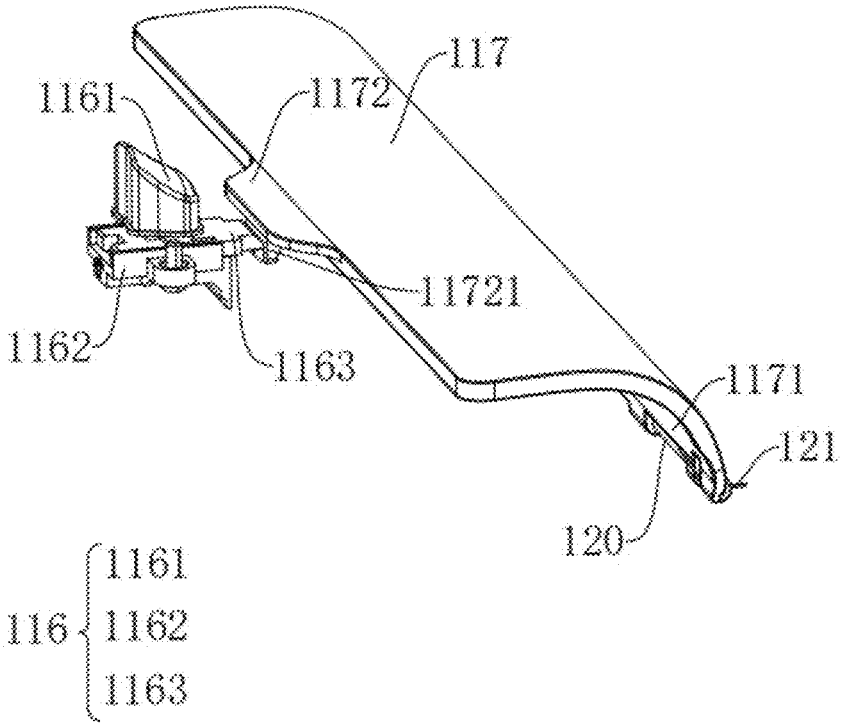
FIG. 8 is a structural view of a cover and a button mechanism according to an embodiment of the present disclosure.

In one embodiment of the present disclosure, as shown in FIGS. 2 and 8, the cleaning device further includes a cover 117. The base 1 defines a second opening 14 facing upward. The second opening 14 is communicated with the receiving cavity 12. The cover 117 is movably arranged at the second opening 14 for optionally covering the second opening 14. It can be understood that the second opening 14 is defined in the first frame portion 151, and the cover 117 is arranged on the first frame portion 151. The cover 117 includes a connecting end 1171 and a free end 1172. The connecting end 1171 is rotatably connected to the base 1. The rotatable connection may be a pivotal joint realized via a rotating shaft 120. The base 1 further includes a button mechanism 116. The button mechanism 116 is configured to lock or release the free end 1172 of the cover 117. The button mechanism 116 includes a button 1161. The button 1161 is disposed on the first extension portion 153. When the user presses the button 1161, the button mechanism 116 releases the free end 1172 of the cover 117, thereby opening the cover 117 to uncover the second opening 14, allowing the user to dump the debris in the dust collection chamber 211 through the second opening 14. With the button mechanism 116, it is possible to prevent the cover 117 from opening due to impact during the cleaning process, thus avoiding debris scattering.

Figure 9:
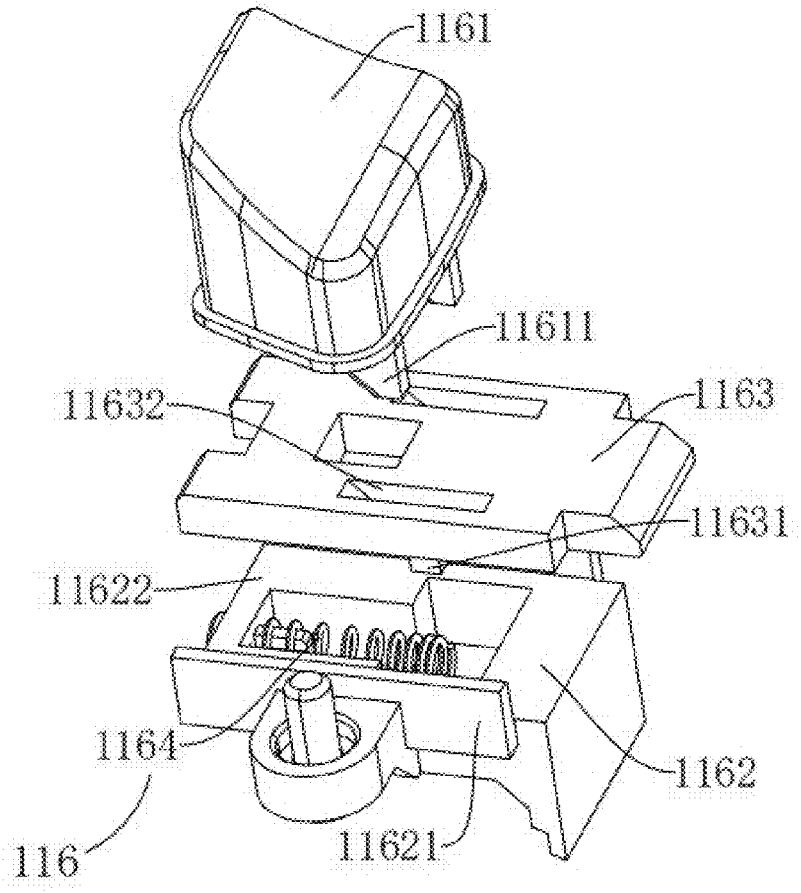
FIG. 9 is an exploded view of the button mechanism according to an embodiment of the present disclosure.

In one embodiment of the present disclosure, as shown in FIGS. 8 and 9, the button mechanism 116 includes a mounting seat 1162, a latch 1163, an elastic member 1164, and a guide structure 11611. The mounting seat 1162 is disposed in the base 1. Further, the mounting seat 1162 is disposed in an inner cavity of the slanted portion 18 of the base 1, and is connected to the slanted portion 18 via a fastener. The mounting seat 1162 is arranged with two vertical plates 11621. The two vertical plates 11621 are arranged opposite to and spaced apart from each other. A sliding slot 11622 is defined between the two vertical plates 11621. The latch 1163 is slidably disposed on the mounting seat 1162 and arranged in the sliding slot 11622. The free end 1172 of the cover 117 is arranged with a door latch 11721. One end of the latch 1163 is configured to press against and lock the door latch 11721. The latch 1163 is arranged with a connecting structure 11631 extending downward. The mounting seat 1162 defines a slot. The connecting structure 11631 is arranged in the slot. One end of the elastic member 1164 is connected to the connecting structure 11631, and the other end of the elastic member 1164 abuts against a wall of the mounting seat 1162 corresponding to the slot. A bottom portion of the button 1161 extends to form an inclined guide structure 11611. The latch 1163 defines a guide hole 11632. The guide structure 11611 is inserted in the guide hole 11632. When the button 1161 is pressed, the guide structure 11611 moves downward to drive the latch 1163 rearward, compressing the elastic member 1164. At this point, the latch 1163 moves rearward and releases the door latch 11721, thereby allowing the cover 117 to open the second opening 14.

In one embodiment of the present disclosure, as shown in FIGS. 2, 8, and 12, the connecting end 1171 of the cover 117 is rotatably connected to the base 1 via the rotating shaft 120. At least one torsion spring 121 sleeves a periphery of the rotating shaft 120. One end of the torsion spring 121 is connected to the cover 117 and the other end of the torsion spring 121 is connected to the base 1. The torsion spring 121 provides a preload force for an opening and closing operation of the cover 117, i.e., the torsion spring 121 is preset with an elastic force. When the button mechanism 116 releases the free end 1172 of the cover 117, the torsion spring 121 drives the cover 117 to rotate open. The base 1 further includes at least one protrusion 122 located at the second opening 14. The connecting end 1171 of the cover 117 is arranged with a shaft sleeve. The shaft sleeve sleeves a periphery of the rotating shaft 120. The protrusion 122 is arranged facing the shaft sleeve of the cover 117. During the opening process of the cover 117, the protrusion 122 frictionally engages with the shaft sleeve, thereby generating a resistance. Particularly, the preload force of the torsion spring 121 is configured to match the resistance generated by the protrusion 122, allowing the cover 117 to open slowly and thus avoiding damage caused by a sudden impact.

In one embodiment of the present disclosure, the cleaning device is not equipped with a circuit, meaning that the cleaning device in this disclosure performs cleaning tasks through mechanical structures and physical principles. Since no circuitry is involved, there are no safety hazards caused by electrical failures, short circuits, or leakage.

In one embodiment of the present disclosure, referring to FIG. 12, the dust collection structure 2 further includes a paddle 23. The paddle 23 is disposed in the dust collection chamber 211 and can slide along a width direction of the dust collection chamber 211. In an example, the paddle 23 is arranged with a slider, and a sliding slot 11622 is defined in the dust collection chamber 211. The paddle 23 slides through a cooperation of the slider and the sliding slot 11622. A shape of the paddle 23 matches a vertical cross section of the dust collection chamber 211, so that the paddle 23 can push the debris in the dust collection chamber 211 from one end of the dust collection chamber 211 to gather the debris at the other end of the dust collection chamber 211, thereby facilitating the user's dumping of the debris to a trash bin.

In one embodiment of the present disclosure, as shown in FIG. 12, the base further includes an anti-collision strip 118. The base 1 includes a front side wall 119. When the base 1 moves forward, the front side wall 119 is prone to collide with furniture, walls, etc. Therefore, the anti-collision strip 118 is arranged along a width direction of the front side wall 119. The anti-collision strip 118 is in a shape of a strip and can be made of a flexible material such as silicone or rubber, which can prevent noise when the front side wall 119 collides with furniture or walls, and also protect the front side wall 119 from damage.

In one embodiment of the present disclosure, as shown in FIG. 1, the handle 4 includes a plurality of connecting segments 41. The plurality of connecting segments 41 are detachably connected to each other. The detachable connection may be a threaded connection or achieved through an interference fit, allowing the user to adjust a length of the handle 4 according to the user's height and facilitating disassembly and transportation. In addition, the plurality of connecting segments 41 of the handle 4 may also be configured to be telescopic.

In one embodiment of the present disclosure, as shown in FIG. 1, the handle 4 is fixedly connected to the base 1, so that the angle between the central axis of the handle 4 and the tangent line at the lowest point of the dust collection face 214 is a fixed angle. The fixed connection between the handle 4 and the base 1 can increase connection strength. In actual use of the cleaning device, a certain amount of friction is required between the dust collection face 214 and the carpet to achieve cleaning. When the handle 4 and the base 1 are not fixedly connected, relative displacement between the handle 4 and the base 1 may frequently occur under an influence of friction, making it difficult for the user to exert force to push the cleaning device, which causes inconvenience.

It should be noted that the above technical features may continue to be combined with each other to form various embodiments not listed above, all of which are considered to fall within the scope described in this specification. Furthermore, for those skilled in the art, modifications or variations can be made based on the above description, and all such modifications and variations shall fall within the scope of protection defined by the appended claims of the present disclosure.

What is claimed is:

1. A cleaning device, comprising:

a base, defining a receiving cavity and a first opening facing downward, wherein the first opening is in communication with the receiving cavity;

a dust collection structure, comprising a dust collection body rotatably arranged in the receiving cavity, wherein the dust collection body defines a dust collection chamber with a dust collection port, the dust collection port is in communication with the dust collection chamber, the dust collection body comprises a dust collection face, at least a portion of the dust collection face is exposed through the first opening, and the dust collection face is capable of rolling contact with an object to be cleaned;

a dust removal structure, located at the first opening and arranged opposite to the dust collection face, wherein when the dust collection body rotates, the dust removal structure scrapes the dust collection face and carries dust on the dust collection face to the dust collection chamber through the dust collection port; and a handle, connected to the base, wherein a central axis of the handle forms an angle with a tangent line at a lowest point of the dust collection;

wherein the base comprises:

at least one flat limiting face, the dust collection body is capable of rotating about a central axis of the dust collection body, a perpendicular distance between the limiting face and the central axis of the dust collection body is less than a rotation radius of the dust collection body, and the limiting face is configured to limit the dust collection body; a top wall of the base is flat and is substantially parallel to the flat limiting face;

a first housing, comprising a first frame portion and an annular handle portion, wherein the annular handle portion is integrally formed as a one-piece structure and is configured to assemble the handle; and a second housing, comprising a second frame portion, wherein the first frame portion and the second frame portion cooperatively form a body portion of the base, and the receiving cavity is defined in the body portion;

wherein the first housing further comprises a first extension portion, the second housing further comprises a second extension portion, and the first extension portion and the second extension portion cooperatively form a slanted portion of the base;

the slanted portion comprises a first end and a second end, the first end is connected to the annular handle portion, the second end is connected to the body portion, and a width of the slanted portion gradually increases from the first end to the second end; and the annular handle portion is configured for the handle to be mounted therein, a mounting portion is formed at a lower side of the annular handle portion, the second extension portion is mounted to the mounting portion and abuts against the lower side of the annular handle portion; an outer diameter of the first end of the slanted portion is substantially the same as an outer diameter of the annular handle portion.

2. The cleaning device according to claim 1, wherein the annular handle portion comprises a first ring wall, a second ring wall connected to the handle, and a plurality of reinforcing ribs, the first ring wall sleeves a periphery of the second ring wall, and the plurality of reinforcing ribs are arranged between and connected to the first ring wall and the second ring wall.

3. The cleaning device according to claim 1, wherein the slanted portion comprises a first side face and a second side face, and each of the first side face and the second side face is an arc-shaped face.

4. The cleaning device according to claim 1, wherein the first frame portion, the first extension portion, and the annular handle portion are integrally formed as a one-piece structure, and the second frame portion and the second extension portion are integrally formed as a one-piece structure.

5. The cleaning device according to claim 1, wherein the base further comprises a top wall, the top wall is arranged with at least one boss extending toward the dust collection body, the at least one boss is flat and arc-shaped and located on a rotation path of the dust collection body, and the limiting face is a bottom face of the boss.

6. The cleaning device according to claim 1, wherein the base further comprises a flat soundproof strip, the soundproof strip is arranged on the flat limiting face, and when the dust collection body rotates to a limit angle, the dust collection body abuts against the soundproof strip.

7. The cleaning device according to claim 5, wherein the base defines a second opening facing upward, the second opening is in communication with the receiving cavity, the base further comprises a cover, the cover is movably arranged at the second opening, and each of the top wall of the base and the cover is flat and arc-shaped.

8. The cleaning device according to claim 1, wherein;

the dust collection face comprises a front dust removal region, a rear dust removal region, bristles arranged on the front dust removal region, and bristles arranged on the rear dust removal region;

the dust removal structure comprises a front dust removal body, the front dust removal body comprises a front dust removal face and bristles arranged on the front dust removal face, the front dust removal face is closely attached to the front dust removal region, the bristles on the front dust removal face and the bristles on the front dust removal region are arranged obliquely upward and facing each other; and the dust removal structure further comprises a rear dust removal body, the rear dust removal body comprises a rear dust removal face and bristles arranged on the rear dust removal face, the rear dust removal face is closely attached to the rear dust removal region, the bristles on the rear dust removal face and the bristles on the rear dust removal region are arranged obliquely upward and facing each other.

9. The cleaning device according to claim 8, wherein the dust collection structure further comprises at least one protruding strip, the at least one protruding strip is flexible and arranged at a middle portion of the dust collection face and divides the dust collection face to the front dust removal region and the rear dust removal region, and when the dust collection body rotates to a limit position, the at least one protruding strip abuts against the front dust removal body or the rear dust removal body.

10. The cleaning device according to claim 1, wherein the base further comprises:

a cover, defining a second opening facing upward, wherein the second opening is in communication with the receiving cavity, the cover is configured to selectively cover the second opening, the cover comprises a connecting end and a free end, and the connecting end is rotatably connected to the base; and a button mechanism, configured to lock or release the free end of the cover and comprising a button, wherein when the button is pressed, the button mechanism releases the free end, and the cover opens the second opening.

11. The cleaning device according to claim 10, wherein the button mechanism comprises:

a mounting seat, arranged in the base;

a latch, slidably arranged on the mounting seat and capable of pressing and locking the free end of the cover;

an elastic member, elastically connected to the mounting seat and the latch; and a guide structure, arranged below the button and connected to the button, wherein the latch defines a guide hole, the guide structure is inserted in the guide hole, and when the button is pressed, the guide structure moves downward to drive the latch to compress the elastic member, and the latch moves backward to release the free end of the cover.

12. The cleaning device according to claim 10, wherein:

the connecting end of the cover is rotatably connected to the base via a rotating shaft;

at least one torsion spring sleeves a periphery of the rotating shaft, the at least one torsion spring is capable of acting on the cover and opening the cover; and the base further comprises at least one protrusion, the at least one protrusion is located at the second opening and arranged facing the connecting end of the cover, during an opening process of the cover, the at least one protrusion frictionally engages with the connecting end and generates a resistance against the connecting end, and the at least one torsion spring and the at least one protrusion cooperatively cause the cover to open slowly.

13. The cleaning device according to claim 1, wherein the cleaning device is free of a circuit.

14. The cleaning device according to claim 1, wherein the base further comprises an anti-collision strip, and the anti-collision strip is arranged on a front side wall of the base.

15. The cleaning device according to claim 1, wherein the handle is fixedly connected to the base, and the angle is a fixed angle.

* * * * *